US008544312B2

(12) United States Patent
Imai et al.

(10) Patent No.: US 8,544,312 B2
(45) Date of Patent: Oct. 1, 2013

(54) PRESS MOLDING DIE STRUCTURE AND METHOD OF PRESS MOLDING WORK

(75) Inventors: Kengo Imai, Shizuoka-Ken (JP); Hidemi Suzuki, Shizuoka-Ken (JP)

(73) Assignee: Suzuki Motor Corporation, Hamamatsu-shi (JP)

( * ) Notice: Subject to any disclaimer, the term of this patent is extended or adjusted under 35 U.S.C. 154(b) by 306 days.

(21) Appl. No.: 13/193,281

(22) Filed: Jul. 28, 2011

(65) Prior Publication Data

US 2012/0049397 A1 Mar. 1, 2012

(30) Foreign Application Priority Data

Aug. 26, 2010 (JP) ..... 2010-189461

(51) Int. Cl.
*B21D 43/00* (2006.01)
*B21D 43/18* (2006.01)

(52) U.S. Cl.
USPC ..... 72/420; 72/422; 72/426; 72/427; 269/21; 269/58

(58) Field of Classification Search
USPC ..... 72/38, 419, 420, 422, 426, 427; 269/21, 269/56, 58
See application file for complete search history.

(56) References Cited

U.S. PATENT DOCUMENTS 2,782,574 A * 2/1957 Copold ..... 451/388
3,884,061 A * 5/1975 Westby ..... 72/38
3,969,918 A * 7/1976 Bernotus et al. ..... 72/337

FOREIGN PATENT DOCUMENTS

JP 10076333 3/1998
JP 10-085654 * 4/1998
JP 10085654 4/1998

* cited by examiner

*Primary Examiner* — David B Jones
(74) *Attorney, Agent, or Firm* — Barnes & Thornburg LLP

(57) ABSTRACT

A press molding die structure having a paired press lower die and press upper die that are relatively movable to each other in which a work transferred into a portion between the press lower die and the press upper die is press-molded thereby to form a molded work. A concave portion is formed to a molding surface of the press lower die, and a suction cup of a vacuum stabilizer is provided to the concave portion formed to the molding surface of the press lower die, wherein the suction cup elastically sucks and retains the work at least at a time when the press molding dies are opened, thereby stabilizing a posture of the work.

4 Claims, 6 Drawing Sheets

PRESS MOLDING DIE STRUCTURE AND METHOD OF PRESS MOLDING WORK

PRIORITY CLAIM

This patent application claims priority to Japanese Patent Application No. 2010-189461, filed 26 Aug. 2010, the disclosure of which is incorporated herein by reference in its entirety.

BACKGROUND

1. Field of the Invention

Disclosed embodiments relate to a manufacturing technology using a metal pressing die, and particularly relates to a press molding die structure and a method of press molding a work in which a plate-shaped work is press molded thereby to form a product work having a three-dimensional shape.

2. Related Art

In automobile industries, there has been adopted a manufacturing technology for press molding and working materials using pressing machines such as a transfer pressing machine and a tandem pressing machine. In case of the transfer pressing machine, a 4 steps-4 dies type automatic pressing line comprising, for example, molding step, cutting step, bending step and holing (piercing) step is used. The work is in turn subjected to press working in the respective dies of the automatic pressing line.

When an operating speed is increased in these pressing machines in order to improve a production efficiency, an operating speed of each of the steps such as molding step or the like, and an elevating speed of a press upper die with respect to that of a press lower die is also increased.

However, when the operating speed of each of the steps such as molding step or the like is increased, there may be a case where the work is dragged toward the press upper die, or a part of the work is stuck to the press upper die at a time of opening the press molding dies, so that the work is randomly moved between the press upper die and the press lower die. In a serious case, there may be a case where the work flies out from the press molding dies.

Further, when the work is randomly moved and sifted, it becomes difficult to take out the work from the press molding die of a prior step and to set the work into the press molding die of a post (next) step. At any rate, the setting of the work cannot be accurately performed. Therefore, it becomes difficult to increase the operating speed of the pressing machines, so that the speed-up of the operating speed is limited to some extent.

On the other hand, in order to improve the operating speed of the pressing machines, there have been proposed a work retaining technology using a suction cup for the pressing machine which is used in the bending step of the transfer pressing machine as disclosed in a Patent Document 1.

The pressing machine disclosed in a Patent Document 1 do not direct to a press molding die used in molding step, but directs to a press molding die used in bending step. This press molding die comprises: an air cylinder accommodated in a lower die body of the press lower die; a work lifter vertically moving by the action of the air cylinder; and the suction cup provided to the work lifter.

Further, a Patent Document 2 discloses a work positioning device having a plurality of suction mechanisms each comprising: a cylinder fixed to a jig; and a suction cup in which a plate-shaped work is sucked and retained by the suction cup.

PRIOR ART DOCUMENT

[Patent Document]

[Patent Document 1] Japanese Patent Laid-Open No. 10-76333

[Patent Document 2] Japanese Patent Laid-Open No. 10-85654

The press molding die used in the pressing machine disclosed in the Patent Literature 1 comprises an air cylinder for vertically moving the work lifter, and the suction cup performs ON/OFF operation so as to synchronize with a motion of this work lifter, whereby the suction cup sucks and retain the work at a predetermined position when the work lifter is operated.

However, in the pressing machine disclosed in the Patent Literature 1, an operation timing of a feeding and conveying device for feeding and conveying the work into the press molding die in the bending step, an operation timing of the work lifter and an operation timing of the suction cup are controlled whereby a rising stroke of the press upper die is controlled, so that a controlling operation becomes complicated, and it is difficult, rather impossible for the pressing machine to be applied to the press molding die in the molding step.

The work positioning device disclosed in the Patent Literature 2 is not considered to be applied to the pressing device in the molding step, so that the work positioning device cannot be applied to the pressing device.

Even if the work positioning device is assumed to be applied to the pressing apparatus, the moving speed of the press molding die of the pressing device cannot be improved at all. Even if the work positioning device is fixed to the press lower die of the pressing apparatus, when a sucking defect causes to the suction cup or a sucking (vacuum) is released, the suction cup is moved upwardly by the action of the spring, so that the work sticks to the press upper die or the sticking of the work to the press upper die is promoted. Therefore, it is impossible to suppress a bounce (flip-flop) of the work.

SUMMARY

The disclosed embodiments have been made to solve the above-mentioned problems, and accordingly, the disclosed embodiments provide a press molding die structure and a method of press molding a work capable of preventing the work from causing a positional displacement that is caused when the work is dragged toward the press molding die at a time of opening the press molding dies, so that a posture of the work can be stabilized and the operation speed of the pressing machine can be increased.

Disclosed embodiments also provide a press molding die structure and a method of press molding a work capable of preventing the work from causing the positional displacement or deformation, so that the operation speed of the pressing machine can be further increased.

In order to solve the above problems, the disclosed embodiments a press molding die structure comprising a paired press lower die and press upper die that are relatively movable to each other in which a work transferred into a portion between the press lower die and the press upper die is press-molded thereby to form a molded work, the press molding die structure comprising: a concave portion formed to a molding surface of the press lower die; and a suction cup of a vacuum stabilizer, the suction cup being provided to the concave portion formed to the molding surface of the press lower die; wherein the suction cup elastically sucks and retains the work at least at a time when the press molding dies are opened, thereby to stabilize a posture of the work.

In order to solve the above problems, the disclosed embodiments also provide a method of press molding a work using a press molding die structure comprising a paired press lower die and press upper die that are relatively movable to each other in which a work transferred into a portion between the press lower die and the press upper die is press-molded thereby to form a molded work, the press molding die structure comprising: a concave portion formed to a molding surface of the press lower die; and a suction cup of a vacuum stabilizer, the suction cup being provided to the concave portion formed to the molding surface of the press lower die, the method is characterized by comprising the steps of: sucking and retaining the work at a time at least when the press molding dies are opened; and stabilizing a posture of the work by the action of the suction cup sucking and retaining the work.

According to the above structure, the disclosed embodiments can exhibits the following advantageous effects. Namely, the work can be prevented from being stuck to the press molding dies when the press molding dies used in a pressing apparatus are opened, and the pressing apparatus has an excellent response. Further, the positional displacement and deformation of the work can be prevented, thereby to stabilize the posture of the work, so that an operation speed of the pressing apparatus can be further increased.

BRIEF DESCRIPTION OF THE DRAWINGS

FIG. 5 is a cross sectional view schematically showing an operation of molding step using a press molding die constituting a pressing apparatus.

FIG. 6 is a cross sectional view schematically showing another embodiment of a press molding die structure used in a pressing apparatus, FIG. 6A is a cross sectional view showing an example of a layout of a suction cup of the vacuum stabilizer provided to the concave portion formed to the die molding surface of the press lower die of the press molding dies at a stage before the suction cup sucks, while

DESCRIPTION OF THE DISCLOSED EMBODIMENTS

Next, an embodiment of the press molding die structure and a method of press molding a work according to the disclosed embodiments will be described with reference to the accompanying drawings.

Figure 1:
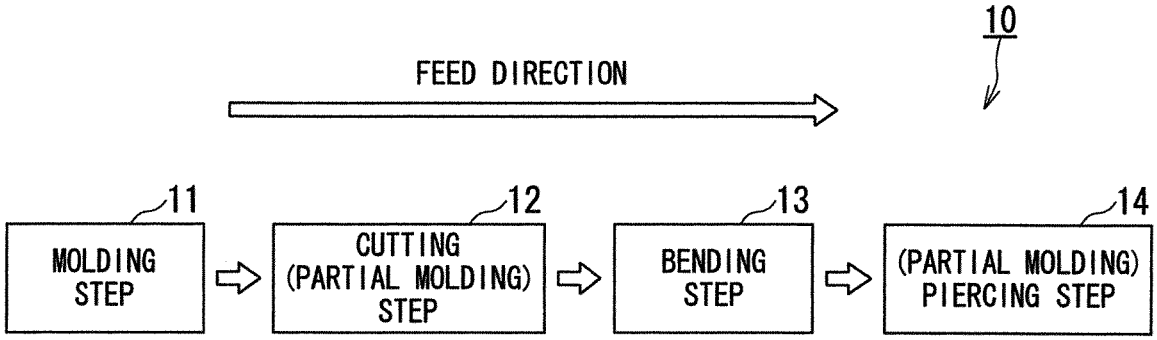
FIG. 1 is a process flow diagram explaining a flow of the respective pressing steps in sequence when a pressing apparatus is used.

FIG. 1 is a process flow diagram explaining a flow of the respective pressing steps in sequence of a pressing apparatus 10 which constitutes a transfer pressing machine (line). This pressing apparatus 10 is used for press molding a plate-shaped work thereby to obtain a product work having a desired shape. The pressing apparatus 10 is basically configured by manufacturing steps of an automatic press line such as "4 steps-4 dies" comprising a molding step 11, a cutting step 12, a bending step 13 and a holing (piercing) step 14.

The pressing apparatus 10 is used for obtaining a desired product shape by feeding a work in turn to the respective molding dies performing the respective pressing steps. In accordance with the shape of the product to be molded by the pressing apparatus 10, as the occasion demands, a press molding die performing both cutting operation and partial-molding operation may be used as the press cutting die of the cutting step 12. Further, a press molding die performing both partial-molding operation and the holing (piercing) operation is used as the press holing die of the holing step 14.

Figure 2:
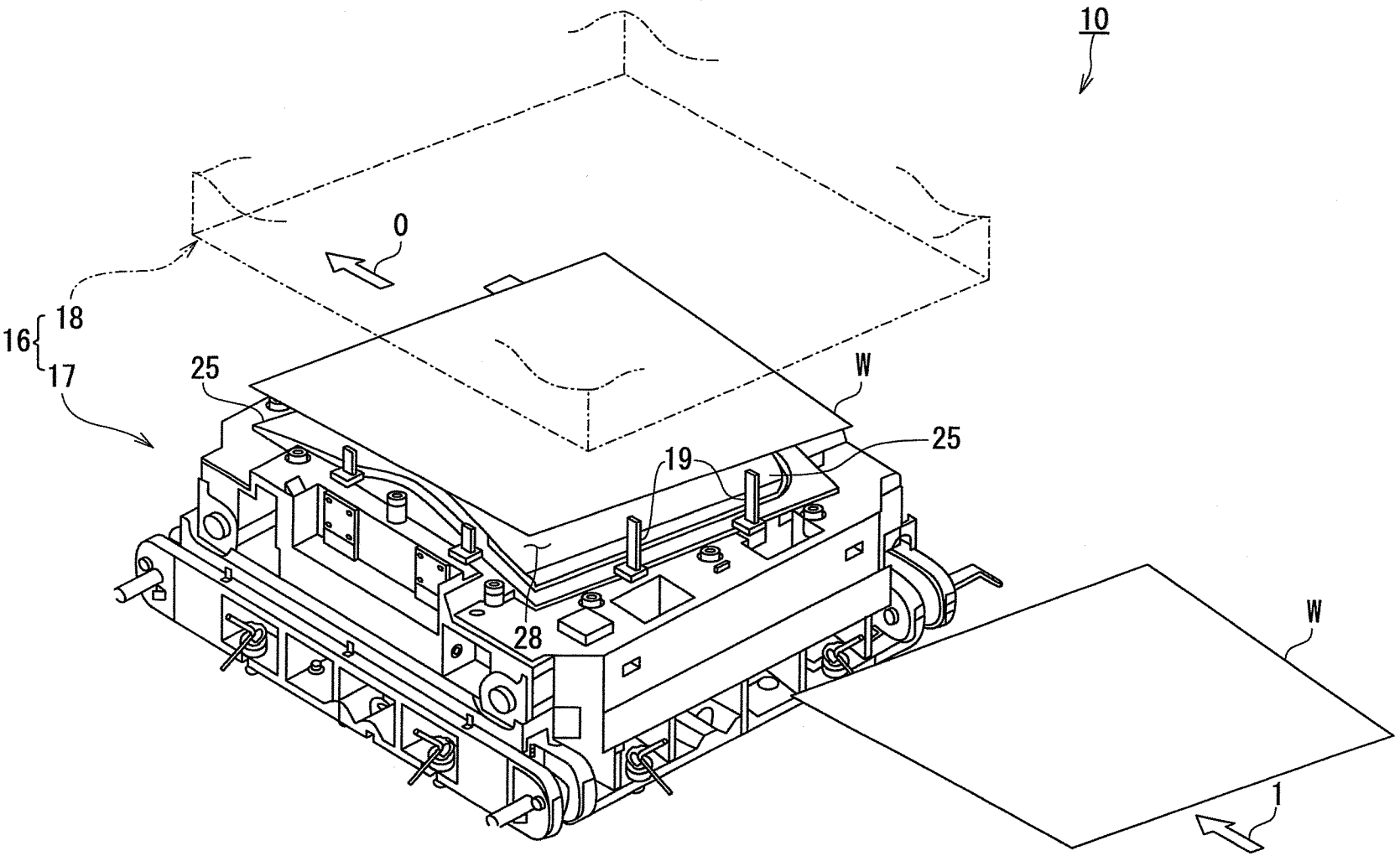
FIG. 2 is a perspective view showing an embodiment of a paired press molding dies used in the pressing apparatus for the molding step.
Figure 3:
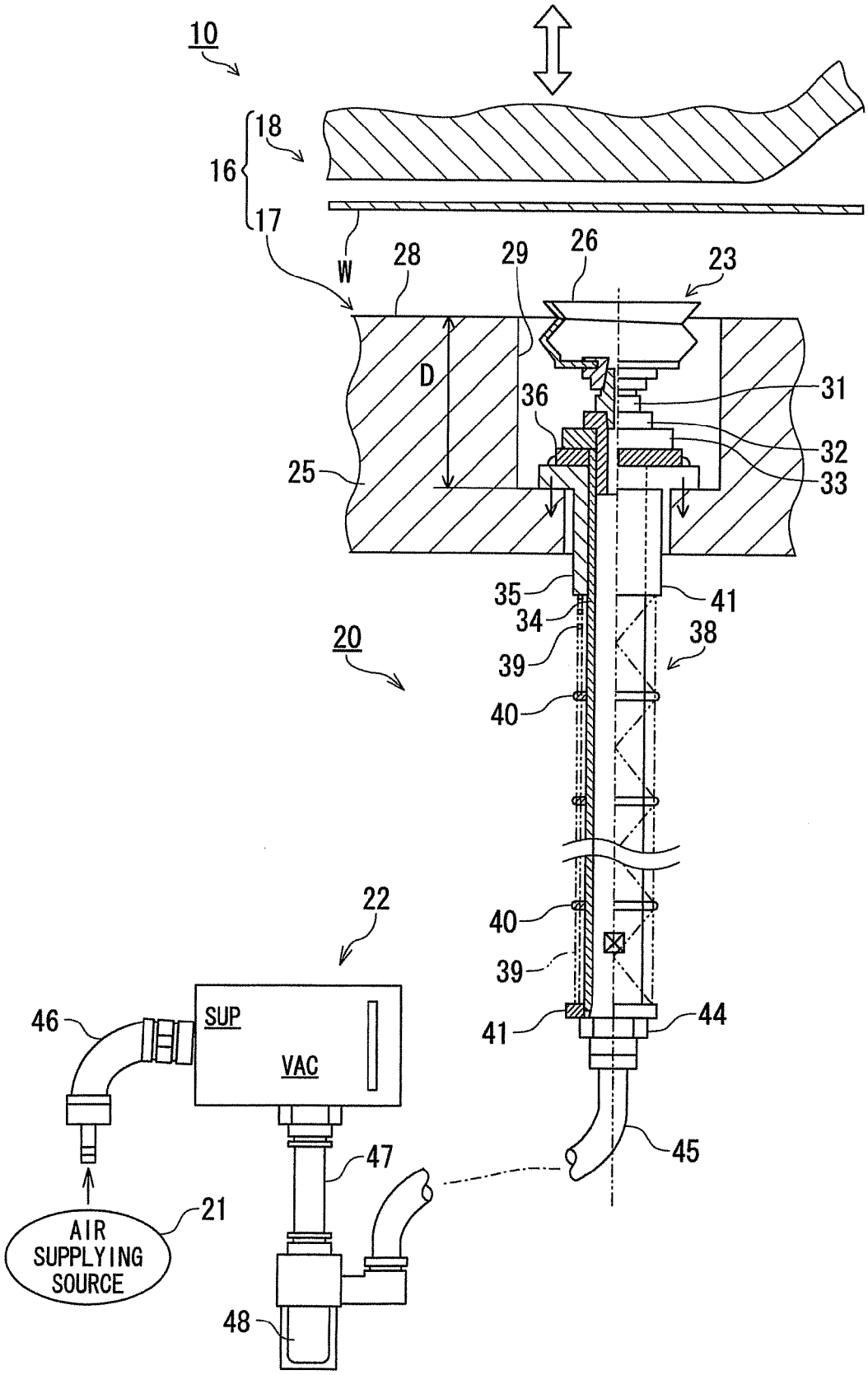
FIG. 3 is a cross-sectional view illustrating a structure of a vacuum stabilizer used in a press molding dies of a pressing apparatus for carrying the molding step.

As the press molding dies 16 in the molding step 11, a press lower die 17 and a press upper die 18 shown in FIGS. 2 and 3 are provided so as to be relatively movable to each other. FIG. 2 shows an example of motion in which the press upper die 18 is vertically moved with respect to a fixed press lower die 17.

The pressing apparatus 10 shown in FIG. 2 constitutes the transfer pressing machine (line), and a shuttle conveyer (not shown) for conveying a work W is provided to a portion between adjacent pressing apparatuses 10. The work (panel) W is carried in and fed into the press molding die 16 of the pressing machine 10 from a direction indicated by an arrow 1, and then the work W is carried out and fed out toward a direction indicated by an arrow 0.

Concretely, a plate-shaped material work W is carried into a portion between the press lower die 17 and the press upper die 18 of the press molding dies 16 of the pressing apparatus 10 by the action of an automatic conveying device such as shuttle conveyer (not shown) or the like. The material work W carried in is descended by a work lifter, and then subjected to a molding work by the press molding dies 16. Thereafter, the work W is again moved upward by the work lifter and carried out to the next step (cutting step) by means of the automatic conveying device.

The plate-shaped material work W carried into the portion between the press lower die 17 and the press upper die 18 of the press molding dies 16 is received at an up-rise position of the work lifter (not shown). When the work lifter descends, the work W is guided by guide members 19 thereby to be guided to a work position. At this work position, the work W is subjected to the press molding work by an elevating (uprising and descending) motion of the press upper die 18 thereby to provide a desired three-dimensional shape.

The molding step 11 means a step for forming a three-dimensional concavo-convex shape from the plate-shaped material work (panel) W, and the molded product after completion of the molding step 11 is defined as a molded work $W_1$. When the press upper die 18 of the press molding dies 16 is detached and upwardly moved from the press lower die 17 in the molding step 11, due to a negative pressure (hereinafter referred to as "die negative pressure") caused at a contact surface between the molded work $W_1$ and the press upper die 18, or due to a viscosity of a processing oil, there may be a fear that the molded work $W_1$ is liable to stick to the press upper die 18. Therefore, a device for preventing the molded work $W_1$ from sticking to the press upper die 18 is provided as a vacuum stabilizer 20.

After completion of the press molding operation in the molding step 11, when the press molding dies 16 are opened, the molded work $W_1$ is normally released by the up-rising motion of the press upper die 18. However, at the time of opening the press molding die 16, the molded work $W_1$ is sometimes dragged and brought to the press upper die so as to follow the die negative pressure caused at the press upper die 18, so that there may be a fear that the molded work $W_1$ is randomly moved or a posture of the molded work $W_1$ becomes unstable. This destabilization of the posture of the work $W_1$ can be prevented by the action of the suction cup 26 of the vacuum stabilizer 20.

In this connection, the vacuum stabilizer 20 is provided to the press lower die 17 of the press molding dies 16 used in the molding step 11. The vacuum stabilizer 20 is a device for preventing the molded work $W_1$ from upwardly moving in a state where the molded work $W_1$ is stuck due to the die negative pressure caused at the press upper die 18, thereby to stabilize the posture of the molded work$_1$.

Namely, the vacuum stabilizer 20 is a work-sticking prevention device for preventing the work form sticking to the press upper die, and the vacuum stabilizer 20 is a device for stabilizing the work posture. That is, the vacuum stabilizer 20 uses a work sucking device 23 such as the suction cup or a vacuum pad or the like, and prevents the molded work $W_1$ from upwardly moving in a state where the molded work $W_1$ is stuck to the press upper die 18 due to the die negative pressure caused at the press upper die 18.

As shown in FIG. 3, the vacuum stabilizer 20 comprises: a negative pressure (vacuum) generating device 22 for generating the negative pressure by air supplied from an air supplying source 21; a work sucking device 23 connected to the above negative pressure (vacuum) generating device 22; and an air controlling device (not shown). The negative pressure (vacuum) generating device 22 is an ejector 25 type device for generating the negative pressure at only a time when air is supplied from the air supplying source 21 to the ejector 25. In place of the ejector 25 type device, a venturi type device can be also used as the negative pressure (vacuum) generating device 22.

The work sucking device 23 shown in FIG. 3 is provided to the press lower die 17 of the press molding dies 16 used in the molding step 11. The work sucking device 23 comprises a suction cup 26 retained by a lower die body 25 of the press lower die 17. When the press molding dies 16 are opened, the suction cup 26 contacts to a lower surface of the molded work $W_1$ thereby to suck and retain the lower surface. After completion of the press molding operation, even if the molded work $W_1$ is upwardly moved so as to follow the die negative pressure of the press upper die 18, the work posture can be stably retained by the suction cup 23 without causing any positional displacement.

At a predetermined portion of the lower die body 25 of the press lower die 17 is provided with a concave portion (or concave groove) 29 opening to a side of die molding surface 28. The suction cup 26 is accommodated in the concave portion 29 so as to be movable in a vertical direction. One or a plurality of the concave portion 29 are provided to the die molding surface 28 of the lower die body 25, so that the suction cup 26 is provided to the concave portion 29 of the lower die body 25. A top portion of the suction cup 29 is somewhat protruded in a free state from the die molding surface. The protrusion length is, for example, several mm to several cm. Further, a guide sleeve 35 formed with a flange is buried in this concave portion 29. The guide sleeve 35 with the flange penetrates through the lower die body 25, and is fixed to the concave portion 29 of the lower die body 25. A hollow shaft 34 is slidably guided in the guide sleeve 35.

The suction cup 26 is provided to a plane portion of the press lower die 17. This plane portion corresponds to a portion where a rising-up amount of the molded work $W_1$ is large due to the die negative pressure of the press upper die 18 when the press molding dies 16 are opened. An attaching position of the suction cup 26 may be set to a plane portion close to a vertical wall of the concave and concavo portion of the die molding surface 28 in the press lower die. Concretely, the suction cup 26 is provided to a plane portion close to the vertical wall of the concave and concavo portion of the molded work $W_1$. When the molded work $W_1$ is panel such as a side body, a door (inner), a rear floor of automobile body or the like, in accordance with a part size or a part shape of a molded product, the attaching position of the suction cup 26 is greatly different. In general, the suction cup 26 is provided to a plane portion of the die molding surface of the press lower die 17. The plane portion corresponds to a portion to become a scrapped portion in a post step (cutting step) of the pressing apparatus 10. In a case where the molded product is the rear floor of an automobile body, the suction cup 26 is provided to a plane portion of the press lower die 17 of which shape corresponds to the product.

Further, as the suction cup 26, a commercially available cup for steel is used. The suction cup 26 is used as a vacuum cup. There can be used various suction cups 26 having various cup shapes such as circular shape, elliptical shape, oval shape or the like, and having various size and kind.

The suction cup 26 is connected to a piping terminal 32 through a connector 31 such as a reducing nipple or the like. This piping terminal 32 is connected to an air hose 45 through the hollow shaft 34 provided with a washer 33. The hollow shaft 34 is slidably inserted within the guide sleeve 35 formed with the flange, and the guide sleeve 35 is buried in the concave portion 29 of the lower die body 25. The hollow shaft 34 is protruded downwardly from the guide sleeve 35. The guide sleeve 35 is fixed to a bottom portion of the concave portion in the lower die body 25.

On the other hand, a shock absorbing member 36 such as a shock absorbing ring or the like constituted by an elastic body is fixed onto the flange of the guide sleeve 35, and the washer 33 for the hollow shaft 34 is detachably supported by this shock absorbing member 36.

At a protruded portion of the hollow shaft 34 extending downward is provided with a multistaged spring mechanism 38 in which a plurality of springs are linearly arranged in a form of multistage. The multistaged spring mechanism 38 is a mechanism formed by combining and arranging, for example, springs 39 such as coil spring or the like, washers 40 and spring retainers 41 in a form of multistage in an axial direction of the hollow shaft 34. The suction cup 26 is elastically retained to the concave portion 29 formed to the lower die body 25 by a spring force (elastic force) of the multistaged spring mechanism 38 under a condition where a spring urging force caused by the multistaged spring mechanism 38 is applied to a side of an accommodating direction (downwardly) of the shock absorbing member 36.

A lower end portion of hollow shaft 34 is connected to an air hose 45 extending from the negative pressure (vacuum) generating device 22 through a one-touch controlled connector 44. At this time, the suction cup 26 of the work sucking device 23 is elastically retained by the multistaged spring mechanism 38, and the hollow shaft 34 is guided in the guide sleeve 35 with the flange and vertically moved, so that a large elevation stroke S can be obtained. Therefore, a sucking movable range (effective elevation stroke S) within which the suction cup 26 is sucked by the work $W_1$ and vertically moved can be increased so as to satisfy, for example, a relation: 20 mm □S=200 mm. Accordingly, it becomes possible to secure a long time for the suction cup 26 to be sucked and retained by the molded work $W_1$. Therefore, an operation time of the suction cup 26 can be prolonged, and a time period during which the urging force (spring force) of the multi-staged spring mechanism 38 is applied to the molded work $W_1$ can be prolonged. As a result, the molded work $W_1$ would not cause a positional displacement at the time of opening the press molding dies 16, and a work stance (work posture) can be stably retained.

In this connection, the air supplying source 21 of the vacuum stabilizer 20 is connected to the negative pressure generating device 22 by an air hose 46 through an air controlling device (not shown), and a work sucking device 23 is sucked by the negative pressure generated by the negative pressure generating device 22, so that the suction cup 26 is operated thereby to conduct a vacuum operation. A plurality of the work sucking devices 23 are provided for each of one vacuum generating device so as to diverge from an air suction filter 48. As one example, two work sucking devices 23 are provided for the vacuum generating device.

Further, the pressing apparatus 10 is configured such that a press shaft of the pressing machine is rotated by a motor drive of an electric motor (not shown) thereby to allow the press molding dies 16 to conduct a stroke movement. The feeding and transferring device (carrying in/out device), the work lifter and the vacuum stabilizer 20 of the pressing apparatus 10 constituting the transfer pressing machine are operated and controlled at predetermined operation timings based on a shaft angle of the pressing apparatus 10.

Figure 4A:
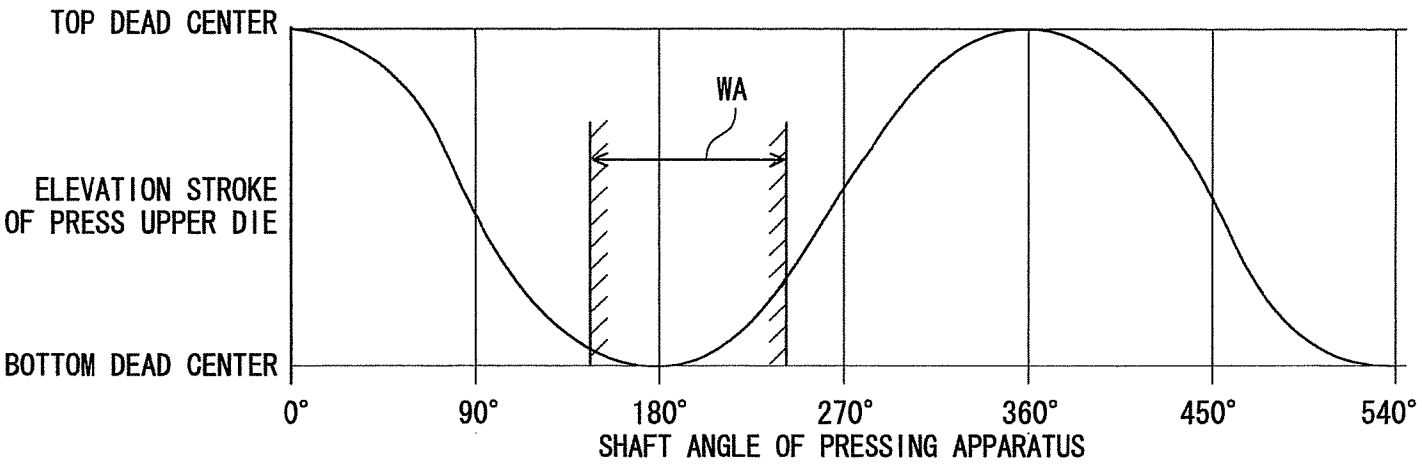
FIG. 4A is a graph showing an example of a relation between a rising stroke (elevating length) of the press molding die constituting the pressing apparatus and an shaft angle of the pressing apparatus.
Figure 4B:
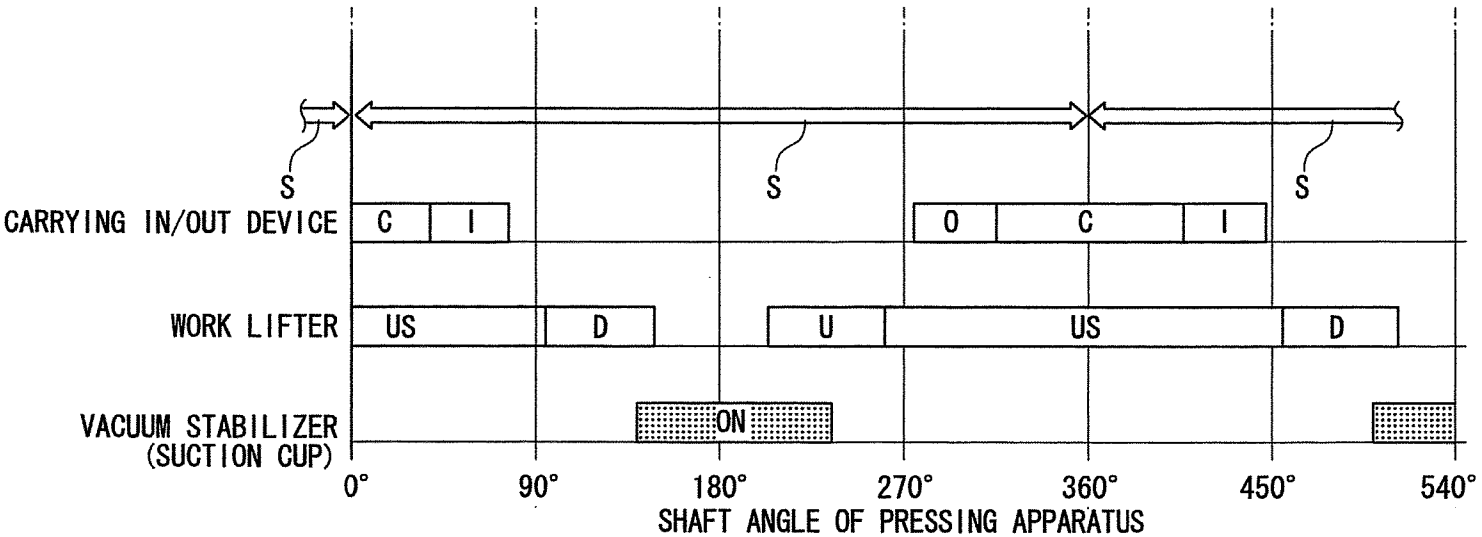
FIG. 4B is a graph showing an example of a relation between: operation timings and operating range (operating time) of a feeding/conveying device, a work lifter and a vacuum stabilizer of the pressing apparatus.

FIG. 4A is a graph showing a relation between an elevation stroke (rising stroke) of the press molding die 16 constituting the pressing apparatus 10 and an shaft angle (crankshaft angle) of the pressing apparatus, and FIG. 4B is a graph showing a relation between: operation timings and operating range (operating time) of a carrying in/out device, a work lifter and a vacuum stabilizer (suction cup) of the pressing apparatus.

Among these figures, FIG. 4A is a graph showing a relation between the elevation stroke of the upper molding die 18 constituting the press molding dies 16 and an shaft angle (crankshaft angle) of the pressing apparatus in the molding step 11. A region WA is a region corresponding to an operation time during which the press upper die 18 makes contact with the work (W1), so that the operation time shows the operation range of the vacuum stabilizer 20.

At a descending step of the press upper die 18, the press upper die 18 contacts a material work (panel) W, and then the work W is subjected to a press molding work by a cooperative motion of the press upper die 18 and the press lower die 17. The region WA denotes a region ranging from a portion at which the molding operation for the work W starts to an intermediate portion at which the molded work W1 is raised after completion of the molding operation. The press upper die 18 contacts to the material work W before the press upper die 18 arrives in bottom dead point (BDP), then the press upper die 18 and the press lower die 17 are cooperatively moved thereby to start the molding operation. When the press molding operation is advanced and then the operation of molding the material work W is completed, the press upper die 18 is drawn apart and raised from the press lower die 17. At this time, even if the molded work $W_1$ together with the press upper die 18 are raised upward due to the die negative pressure or the like, the molded work $W_1$ is retained in a state where the molded work $W_1$ is sucked by the suction cup 26 by a vacuuming action of the vacuum stabilizer 20, whereby the posture of the work W can be retained.

Further, one example of the operation timings of a carrying in/out device, a work lifter and the vacuum stabilizer 20 are shown in FIG. 4B in relation to the shaft angle (elevation stroke S of the press upper die 18) of the pressing apparatus 10.

The carrying in/out device performs a carrying-in operation I and a carrying-out operation O at predetermined operation timing responsive to the shaft angle of the pressing apparatus 10. A reference symbol C between the carrying-out operation O and the carrying-in operation I denotes an operation for transporting the work W to a next step (cutting step) by means of a shuttle conveyer.

Furthermore, in the molding step, the work lifter is cooperatively moved in conjunction with the carrying in/out device. The work lifter performs a descending motion D and an uprising motion U at a predetermined operation timing corresponding to the shaft angle of the pressing apparatus 10. The reference sign US in the work lifter in an operated condition denotes a standby term for which the work lifter is waiting at the uprising position.

On the other hand, the vacuum stabilizer 20 performs a vacuum motion (ON) in conjunction with the press molding work of the pressing apparatus 10 in the press molding step. The press molding conditions and the motions of the pressing apparatus 10 are different in accordance with the shape or size of the molded product, so that the operation time and the operation timing are also different. Concretely, the vacuum stabilizer 20 is operated and performs the vacuum motion (ON) at a range where the press upper die 18 contacts the work W ($W_1$).

The operation timing of the vacuum stabilizer 20 is controlled by opening or closing a solenoid valve for suction cup absorbing, the solenoid valve being provided to an air supplying line extended from an air supplying source 21 shown in FIG. 3, or the vacuum stabilizer 20 is also controlled by opening or closing an air valve of an air control device. At this time, there is no space having a large volume for an elevating cylinder in the way of an air suction line extended from the negative pressure generating device 22 and connected to the suction cup 26, so that a response of the negative pressure can be improved.

Next, an operation of the vacuum stabilizer 20 will be explained hereunder.

In the molding step 11 of the transfer press machine, the operation timings of the carry in/out device, the work lifter and the vacuum stabilizer 20 are determined as one example as shown in FIG. 3 on the basis of the shaft angle of the pressing apparatus 10 and in accordance with the size, the shape of the work ($W_1$) and the pressing condition.

Among the above equipments, the negative pressure generated by the negative pressure generating device 22 is rapidly transmitted to a work sucking device 23 through negative pressure lines (47, 48 and 45), and the vacuum stabilizer 20 makes the suction cup 26 to perform a sucking motion. When the material work (panel) W is carried in the press molding die 12 and descended so as to be disposed on the press lower die 17, a lower surface of the material work (panel) W is contacted by the suction cup 26 due to the above sucking motion by the suction cup 26, whereby the work W is sucked and retained.

Figure 5A:
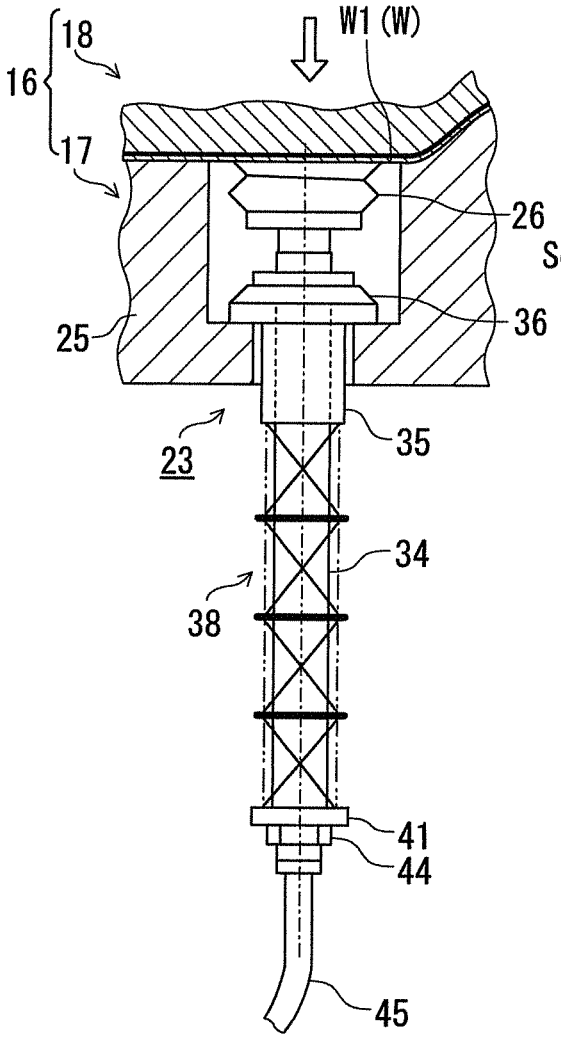
FIG. 5A is a view showing the operation at the time of press molding by a press molding die.
Figure 5B:
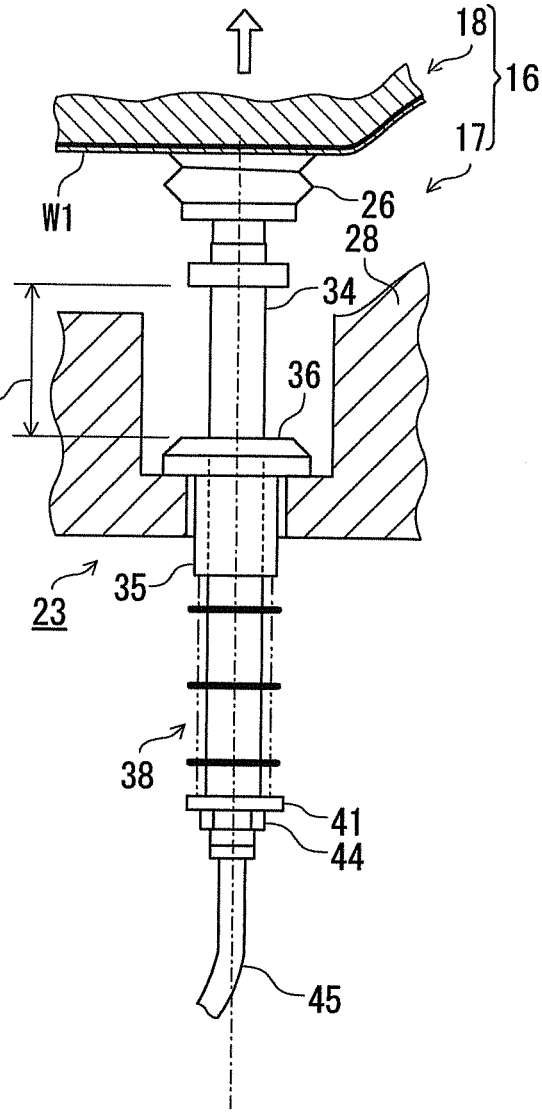
FIG. 5B is a view showing the operation at the time of rising the press upper die when the press molding dies are opened.

On the other hand, in almost synchronization with the sucking motion of the suction cup 26, the press upper die 18 descends and press-contacts to the material work W from upper direction, thereby to start the press molding step as shown in FIG. 5A. At a time of starting the press molding by using the press molding die 16, the suction cup 26 is elastically retained by a shock absorbing material 36 which is elastically deformable, whereby the suction cup 26 sucks and retains the material work W on the die molding surface 28 of the press lower die 17. At this time, a top portion of the suction cup 26 is almost flashed with the die molding surface 28 of the press lower die 17. Even if the suction cup 26 is almost flashed with the die molding surface 28 of the press lower die 17, a deformation of the suction cup 26 is performed within an elastic range and the deformation amount is small, so that a plastic deformation of the suction cup 26 can be prevented. Accordingly, the deformation amount of the suction cup 26 at the molding step using the press molding die can be suppressed to a small amount, so that a durability and a life span of the suction cup 26 can be advantageously improved.

The press molding operation is advanced from the starting the molding operation using the press molding dies 16, and when the press upper die 18 passes through a bottom dead center (BDC) shown in FIG. 5A thereby to complete the molding operation, the press upper die 18 draws apart from the press lower die 17 and moves upwards.

When the press upper die 18 enters into an up-rising stroke at the time of opening the press molding dies 16, the molded work $W_1$ is sucked and up-rose by the die negative pressure. However, even if the molded work $W_1$ is up-rose so as to follow the uprising of the press upper die 18, the suction cup 26 is retained in a sucked condition due to the negative pressure (vacuum) function, whereby the suction cup 26 is up-rose together with the molded work $W_1$.

The up-rising motion of the suction cup 26 is performed in such a manner that the hollow shaft 34 is guided by a guide sleeve 35 thereby to slide the suction cup 26, so that a positional displacement caused by the up-rising of the molded work $W_1$ can be prevented. The molded work $W_1$ is up-rose while maintaining a work posture by the suction cup 26, so that the molded work W1 can be correctly transformed.

Accordingly, the operating speed of the pressing apparatus 10 can be increased, and even if the pressing operation of the pressing apparatus 10 is quickened, a stable posture or stance of the molded work $W_1$ can be maintained without causing any positional displacement. Further, even if the molded work $W_1$ is dragged or pulled by the die negative pressure of the press upper die 18 and up-rose in a pulled state, the suction cup 26 can be extended. Therefore, a sucking range (effective elevating stroke Sc) of the suction cup 26 can be broadened, whereby the stable work posture can be retained.

In the work sucking device 23, while the molded work W1 is sucked by the suction cup 26, a contractive force (spring urging force) of the multi-staged spring mechanism 38 is applied in downward direction. Until a downward spring urging force larger than the die negative pressure of the press upper die 18 is applied to the suction cup 26, the suction cup 26 is retained in a state where the suction cup 26 is sucked to the molded work $W_1$ by the negative pressure.

In addition, the suction cup 26 is up-rose and descended by being slidably guided by the hollow shaft 34, so that a large elevation stroke S can be secured and the operation time of the suction cup 26 can be extended. The suction cup 26 can prolong a duration time when the spring urging force of the multi-staged spring mechanism 38 is applied to the molded work $W_1$. During a time when the suction cup 26 is sucked by the molded work $W_1$, the spring urging force is applied to the molded work $W_1$, so that the work posture can be maintained to be stable.

Further, the vacuum stabilizer 20 can be also configured in the following manner. Namely, an elastically deformable coil spring type is adopted as the air hose (air tube) 45 connected to the work sucking device 23, so that the air hose 45 can follow the vertical movement of the suction cup 26. When an elastically deformable, soft and flexible tube is adopted as a material for constituting the air hose, the suction cup 26 can smoothly perform the uprising/descending stroke. Furthermore, an interference between the air hose 45 and the pressing apparatus 10 can be eliminated, and breakage, trouble failure and leakage of air can be effectively prevented.

In addition, as the suction cup 26 used in the work sucking device 23, there can be adopted a commercially available cup designed for sucking only a steel plate. The suction cup 26 can take a prompt action on changing the pressing conditions of the molded work $W_1$. The suction cup 26 has a simple structure, so that it is easy to perform a maintenance work for repairing or replacing the suction cup 26.

In the press molding die structure shown in FIG. 2 to FIG. 5, the suction cup 26 of the vacuum stabilizer 20 is provided to the press molding dies 16 of the pressing apparatus 10 used in the pressing step 11, and this suction cup 26 elastically sucks and retains the work W ($W_1$) at a time of at least opening the press molding dies, thereby to stabilize the work stance (work posture). Therefore, it becomes possible to prevent the molded body $W_1$ from sticking to the press upper die 18 and prevented from being dragged and brought by the press upper die 18. Further, it becomes also possible to prevent the work from causing the positional displacement or deformation. Accordingly, a press operating speed of the pressing apparatus 10 can be increased, and even if the operating speed of the pressing apparatus 10 is increased, the positional displacement of the work and the work deformation can be surely prevented. In this connection, the operating speed of the pressing apparatus 10 is expressed by SPM as an index which is defined as the number of products to be manufactured per one minute.

In the pressing apparatus used as the transfer pressing machine, the press operating speed SPM is different in cases where the work W is a large-sized panel, a medium-sized panel or a small-sized panel. However, when the suction cup 26 of the vacuum stabilizer 20 is provided to the molding step 11, the press operating speed SPM can be increased at a rate of 20 to 50% or so.

For example, in case of the large-sized panel such as a side body of a vehicle, an upper limit value of the press operating speed SPM was improved to be 7 to 8 SPM from a conventional value of 6 SPM.

Further, in case of the medium-sized panel such as door inner of a vehicle, an upper limit value of the press operating speed SPM was improved to be 13.5 SPM from a conventional value of 10 SPM. Even in case of a pressing apparatus using a tandem press machine in place of the transfer press machine, the upper limit value of the press operating speed SPM was also increased.

According to this embodiment, the suction cup 26 is provided to the work sucking device 23 of the vacuum stabilizer 20, and the work posture of the molded work $W_1$ at the time of opening the press molding dies is stabilized. Therefore, even if the operating speed of the pressing apparatus 10 is increased, a positioning error of the molded work $W_1$ to be transferred to the next step (bending step) can be prevented, thus contributing to improve the productivity of the work product.

In this connection, the transfer press machine (line) is a pressing machine for working a work by simultaneously operating the respective steps such as, for example, a molding step, a cutting step, a bending step and a piercing step or the like. In order to transfer the material work between the respective steps, an automatic transfer device, so called, a "feed bar" is used.

In contrast, the tandem press machine (line) is a press line in which the dies of the respective steps are independently operated, and in order to transfer the material work between the respective steps, a robot and a cross bar are used.

Further, FIG. 6 shows another embodiment according to the disclosed embodiments.

The pressing apparatus 10A shown in this embodiment include a press molding die 16A used for a molding step in a transfer press machine. An overall structure and arrangements of elements or parts of the press molding die 16A shown in this embodiment are substantially the same as those of the press molding die 16 shown in FIGS. 2 and 3, so that these elements and parts are not described herein in detail by adding the same reference signs to the corresponding elements or parts.

In the press molding die 16A, a plate-shaped material work W is carried into a portion between a press lower die 17A and the press upper die 18A, and this work W is subjected to a press molding work by an uprising and descending motion of the press upper die 18A. A work sucking device 23A of a vacuum stabilizer 20 is provided to the press lower die 17A. An overall structure of the of the vacuum stabilizer 20 except a work sucking device 23A is the same as that of the work sucking device shown in FIG. 3, so that detailed explanations on these same elements are omitted by adding the same reference signs.

In the work sucking device 23A, a fixed type or semi-fixed type suction cup 60 is provided to a concave portion 29 or a concave groove formed to the press lower die 17A and a die molding surface 28 thereof. The suction cup 60 is connected to an air hose 45 through a connection part and a piping terminal 32, so that a negative pressure is supplied to the suction cup 60 from a negative pressure generating device (not shown). In this connection, the reference sign 35 denotes a guide sleeve having a flange, while the reference sign 36 denotes a shock absorbing material.

Figure 6A:
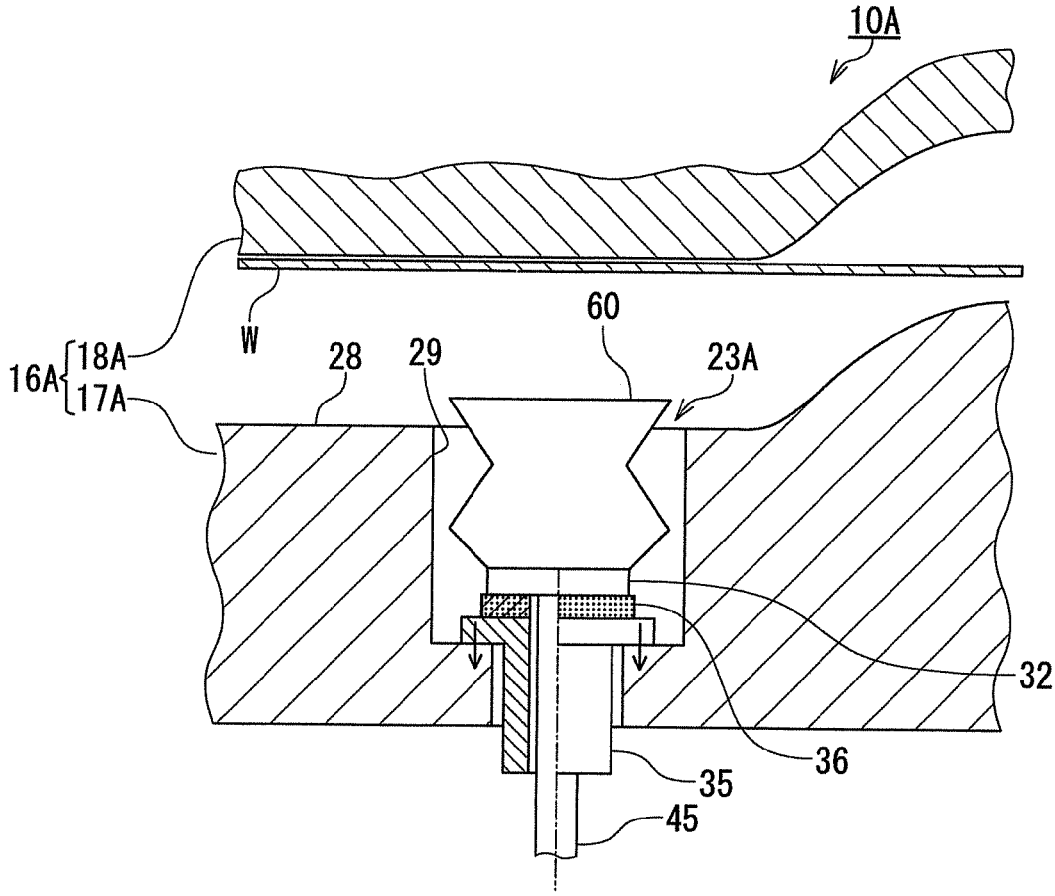
Figure 6B:
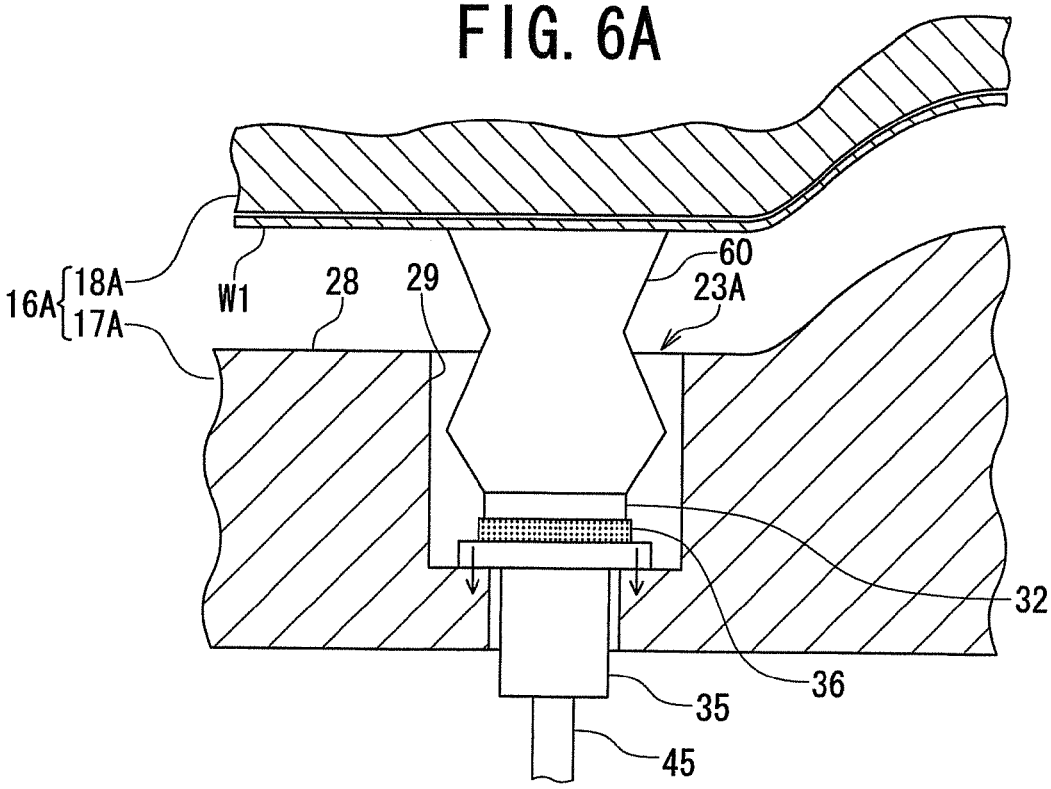
FIG. 6B is a cross sectional view showing an example of a layout of the suction cup at a stage where the suction cup sucks.

In a natural state before the suction cup 60 sucks the work W as shown in FIG. 6A, the suction cup 60 is upwardly protruded from the die molding surface of the press lower die 17A. During the sucking the work W as shown in FIG. 6B, the suction cup 60 contacts the work W ($W_1$) and extended, thereby to suck and retain the work W ($W_1$). When the press lower die 18A of the press molding dies 16A performs uprising/descending motion, the work W is clamped at a portion between the press upper die 18A and the die molding surface 28 of the press lower die 17A whereby the work W is subjected to a press molding work.

In order to prevent phenomena such that the molded work $W_1$ is stuck to the press upper die 18A after completion of the molding step using the press molding dies 16A, the vacuum stabilizer 20 is provided. The suction cup 60 of the vacuum stabilizer 20 imparts a negative pressure force (vacuum force, retracting force) which is larger than a die negative pressure of the press upper die 18A. The negative pressure force (vacuum force, retracting force) is imparted to the molded work $W_1$, so that the molded work $W_1$ can be softly peeled off from the press upper die 18A.

The suction cup 60 of the work sucking device 23A sucks and retains the molded work $W_1$ at the time of at least opening the press molding dies, so that when the molded work $W_1$ is moved upwardly due to the die negative pressure of the press upper die 18A, the suction cup 60 is elastically deformed and extended. Due to the extension caused by the elastic deformation of the suction cup 60, the suction cup 60 sucks and retains the molded work $W_1$, thereby to correctly retain the work posture.

However, in this embodiment, a sucking and retainable range (effective stroke) of the suction cup 60 by utilizing the elastic deformation of the suction cup 60 is small, and an operation time of the vacuum stabilizer 20 is short, so that an operation range is disadvantageously narrowed. This suction cup 60 is suitable for the small-sized panel or a small-sized work having a small amount of irregularities or deformations. Therefore, the suction cup 60 is not suitable for a work such as a large-sized panel.

Further, the suction cup 60 of the work sucking device 23A used in this embodiment exhibits a large amount of deformation at a cup portion, so that there may be posed a problem such that a durability of the suction cup 60 is low, and it is necessary to frequently replace the used suction cup with a new one. However, a commercially available general cup can be easily used as the suction cup 60. Therefore, the replacing cost of the suction cup 60 is low, thus resulting into an excellence in economy.

What is claimed is:

1. A press molding die structure comprising;

a paired press lower die and press upper die that are relatively movable to each other, wherein a work transferred into a portion between the press lower die and the press upper die is press-molded so as to form a molded work;

a concave portion formed to a molding surface of the press lower die; and a suction cup of a vacuum stabilizer, the suction cup being provided to the concave portion formed to the molding surface of the press lower die;

wherein the suction cup elastically sucks and retains the work at least at a time when the press molding dies are opened, thereby stabilizing a posture of the work.

2. The press molding die structure according to claim 1, wherein the suction cup is positioned near the concave portion formed to the molding surface of the press lower die, and the suction cup sucks and retains the work at least at a time when the press molding dies are opened during molding and the press upper die moves upward, thereby preventing the work from causing a positional displacement.

3. The press molding die structure according to claim 1, wherein the suction cup is urged by a spring that is accommodated in the concave portion formed to the molding surface of the press lower die, the suction cup is configured such that when the press molding dies are opened during molding and the press upper die moves upward, the suction cup sucking and retaining the molded work is extensionally moved so as to follow a movement of the press upper die, and a spring urging force is applied to the molded work while the suction cup is sucking and retaining the molded work.

4. A method of press molding a work using a press molding die structure comprising a paired press lower die and press upper die that are relatively movable to each other in which a work transferred into a portion between the press lower die and the press upper die is press-molded thereby to form a molded work, the press molding die structure comprising: a concave portion formed to a molding surface of the press lower die; and a suction cup of a vacuum stabilizer, the suction cup being provided to the concave portion formed to the molding surface of the press lower die, the method comprising:

sucking and retaining the work at a time at least when the press molding dies are opened; and stabilizing a posture of the work by the action of the suction cup sucking and retaining the work.

* * * * *